United States Patent [19]

Harris

[11] Patent Number: 4,896,796

[45] Date of Patent: Jan. 30, 1990

[54] STRIPING DISPENSER PACKAGE FOR VISCOUS PRODUCTS

[75] Inventor: Kurt N. Harris, Haskins, Ohio

[73] Assignee: Owens-Illinois Closure Inc., Toledo, Ohio

[21] Appl. No.: 272,972

[22] Filed: Nov. 18, 1988

[51] Int. Cl.[4] ..... B67D 5/56; B65D 25/40

[52] U.S. Cl. ..... 222/145; 222/94; 222/129; 222/575; 239/549

[58] Field of Search ..... 222/94, 129, 145, 575; 239/548, 549, 552, 553

[56] References Cited

U.S. PATENT DOCUMENTS

| | | | |
|---|---|---|---|
| 2,147,686 | 2/1939 | Bagby | 222/129 |
| 2,873,887 | 2/1959 | Spero | 222/94 |
| 2,959,327 | 11/1960 | Bloom | 222/94 |
| 4,437,584 | 3/1984 | Connors et al. | 222/137 |
| 4,437,591 | 3/1984 | von Schuckmann | 222/391 |
| 4,438,871 | 3/1984 | Eckert | 222/137 |
| 4,461,403 | 7/1984 | Prahs | 222/129 |
| 4,691,847 | 9/1987 | Ford et al. | 222/259 |
| 4,826,044 | 5/1989 | Volfson | 222/145 |

FOREIGN PATENT DOCUMENTS

| | | | |
|---|---|---|---|
| 622969 | 6/1961 | Canada | 222/94 |
| 645813 | 7/1962 | Canada | 222/94 |
| 654838 | 12/1962 | Canada | 222/94 |

*Primary Examiner*—Kevin P. Shaver
*Assistant Examiner*—Steven M. Reiss

[57] ABSTRACT

A hand operable dispensing package for dispensing first and second viscous products in a composite product having a bead of the first viscous product and a plurality of spaced apart longitudinally extending stripes of the second viscous product on the outside of the bead of the first viscous product. The dispensing package has a polygonal elongate dispensing spout with a generally star-shaped tip to dispense the first viscous product in a star-shaped configuration with a core portion and a plurality of lobes extending outwardly from the core portion, and a circular annular insert snugly positioned in the dispensing spout with an outer surface of an inner portion of the annular insert and an inner surface of an inner portion of the dispensing spout defining an annular recess and a circumferential series of longitudinally extending passages. The second viscous product is packaged in the annular recess and the first viscous product is packaged in a portion of the dispensing below the annular recess and at least to the level of a free end of the annular insert. The annular insert has a tapered portion which defines an annular chamber with the dispensing spout, and the annular chamber receives the second viscous product from the longitudinally extending passages and dispenses it strips at the tips of the lobed portions of the first viscous product. The dispensing package is provided with a hand operable pumping mechanism to simultaneously pressurize the first viscous product and the second viscous product.

22 Claims, 3 Drawing Sheets

STRIPING DISPENSER PACKAGE FOR VISCOUS PRODUCTS

BACKGROUND OF THE INVENTION

1. Field of the Invention

This invention relates to a hand-operable dispensing package for a viscous product such as a gel, a cream, or a paste such as toothpaste. More particularly, this invention relates to a dispensing package which simultaneously dispenses first and second viscous products in a single bead that is made up of a core of the first product with spaced apart strips or stripes of the second product on the outside of the first product.

2. Description of the Prior Art

U.S. Pat. No. 4,437,591 (A. von Schuckmann) discloses a prior art hand-operable dispensing package for a viscous product in which the product is contained within a cylindrical portion of the package and is dispensed in the form of a bead through a dispensing opening at an end of the package under the influence of a hand-operable pumping element at the dispensing end of the package, in combination with a unidirectionally movable piston which is mechanically linked to the pumping element so that it advances step by step toward the dispensing end of the package to effect the dispensing of product therefrom. However, a dispenser according to this reference dispenses a bead of uniform color and composition from but a single viscous product supply.

The concept of laying strips or stripes of a second viscous product onto a core of a first viscous product being dispensed from a viscous product dispensing package is disclosed in U.S. Pat. No. 4,461,403 (H. Prahs), and dispensers of this type have gained popularity in the dispensing of toothpaste in multiple colors. However, the dispenser of this reference applies the second product to the first product only over a portion of the periphery thereof. U.S. Pat. No. 4,437,584 (Connors et al.), in reference to the embodiment illustrated in FIG. 5 of the drawing thereof, also discloses a striping dispenser, and while the dispenser of this reference appears to apply a second viscous product to the exterior of a first viscous product in a circumferentially uniform pattern, the second product is brought into communication with the first product through slots at locations substantially inwardly of the dispensing outlet of the container, and the slots are subject to being gradually covered by the first product as striped product is dispensed from the container, which would detract from the effectiveness of striping during the final stages of the dispensing of the product.

SUMMARY OF THE INVENTION

According to the present invention there is provided a dispensing package for simultaneously dispensing first and second viscous products with the second viscous product being applied in spaced apart strips or stripes on a core of the first viscous product. The first and second viscous products are packaged in the body of the dispenser in axially aligned masses with the second viscous product being positioned closer to the dispensing end of the dispenser than the first viscous product. The dispensing end of the container is provided with an annular dispensing spout which is generally square in its interior cross-section and which has a star-shaped opening at its tip to dispense product therefrom in a bead with a plurality of circumferentially spaced apart and outwardly projecting lobes. An annular insert which is generally circular in its exterior cross-section is snugly positioned within the dispensing spout and has an inner end that extends downwardly therefrom into the interior of the container at least to the initial level of the first viscous product. Because the annular insert is generally circular in its exterior configuration and the dispensing spout is generally square in its interior configuration, a series of circumferentially spaced apart and longitudinally extending passages is defined between the annular insert and the dispensing spout. These passages terminate in an annular chamber adjacent the star-shaped opening at the tip of the discharge spout, the annular chamber being defined by the interior of the dispensing spout, a tapered tip portion of the annular insert, and the underside of the star-shaped opening at the tip of the discharge spout. The interior of the annular insert is in communication with the first viscous product, and the longitudinal passages between the inner end of the annular insert and the dispensing spout are in communication with the second viscous product. Thus, when pumping pressure is applied to the viscous products, for example, by a unidirectionally movable pumping piston within the dispensing package, the first and second viscous products, which are in contact with one another, are simultaneously pressurized and, therefore, simultaneously dispensed through the dispensing spout with the second viscous product passing through the longitudinal passages between the outside of the annular insert and the inside of the dispensing spout, the annular chamber adjacent the opening at the discharge spout, and then in longitudinal strips or stripes on the tips of the lobes of the first viscous product which are formed by the star-shaped opening.

Accordingly, it is an object of the present invention to provide an improved dispensing package for the simultaneous dispensing of first and second viscous products. More particularly, it is an object of the present invention to provide a simple, reliable and relatively inexpensive hand-operable dispensing package for the simultaneous dispensing of first and second viscous products with one of such viscous products forming strips or stripes on the exterior of the other of the viscous products.

For a further understanding of the present invention and the objects thereof, attention is directed to the drawing and the following brief description thereof, to the detailed description of the preferred embodiment, and to the appended claims.

DETAILED DESCRIPTION OF THE PREFERRED EMBODIMENT

Figure 1:
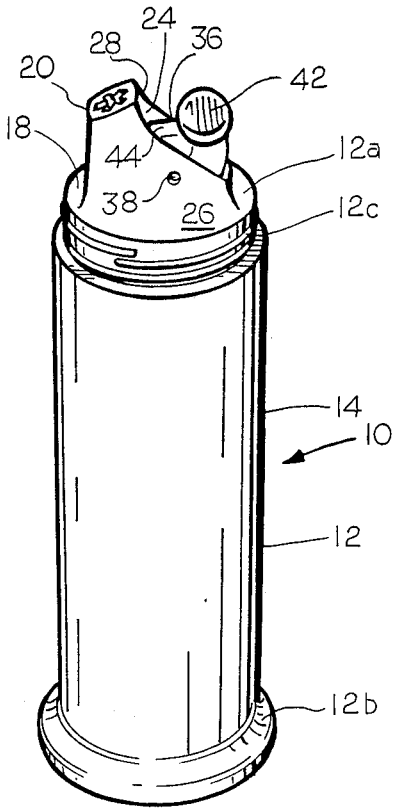
FIG. 1 is a perspective view of a striping dispenser package for viscous products according to the preferred embodiment of the present invention.

As is shown in the various drawing figures, according to the present invention there is provided a dispensing package which is generally identified by reference numeral 10. The dispensing package 10 is suitable for the packaging and dispensing of a first viscous product P1 from a mass of such product, for example, a gel, a cream, or a paste such as toothpaste, and is made up of a generally cylindrical container 12 which has a dispensing end 12*a* that is at the top of the dispensing package 10 in the illustrated upright orientation of the dispensing package 10. Further, the generally cylindrical container 12 also has a bottom end 12*b*. The dispensing package 10 may be provided with an inverted, cup-shaped closure, not shown, which may be threadably secured to an externally threaded portion 12*c* at the dispening end 12*a* of the container 12 to permit closing of the dispensing package 10 until it is ready for first use and thereafter during periods of time when it is not in use.

The generally cylindrical container 12 is made up of a generally cylindrical body portion 14 which, preferably, is circular in cross-section. The body portion 14 of the container 12 is preferably formed from a generally rigid thermoplastic material, preferably a material whose principal ingredient is polypropylene or high density polyethylene, by injection molding, so long as any such material is compatible with the products to be packaged in contact therewith. The container 12 also includes a one-way movable piston 16 which is initially positioned within the body portion 14 near the bottom end 12*b* of the container 12, and the movable piston 16 is also preferably formed from a generally rigid thermoplastic material, such as polypropylene or high density polyethylene.

The dispensing end 12*a* of the container 12 is provided with a transversely extending end structure 18 having a dispensing spout 20 which is in fluid communication with the product P1 within the container 12. The dispensing spout 20 has a tip 22 which is generally star-shaped in cross-section, having a core portion 22*a* with a plurality of circumferentially spaced lobe portions 22*b* extending radially outwardly therefrom. While the tip 22 is illustrated as being symmetrical in configuration, it is also contemplated that non-symmetrical configurations may be employed for ornamental or aesthetic reasons, for example, a clover leaf design. In any case, the end structure 18 of the dispensing end 12*a* of the dispensing container 12 further has an outwardly facing recess 24 which is defined by spaced apart side walls 26 and 28, a bottom wall 30, the dispensing spout 20, and an end wall 32 which is spaced from the dispensing spout 20. The recess 24 receives a major portion 34 of a complex dispensing pump 36, the dispensing pump 36 being pivotally attached to the sidewalls 26 and 28, for example, by axially aligned projections (not shown) which are received in apertures 38 and 40 of the sidewalls 26 and 28, respectively, for oscillation of the dispensing pump 36 about an axis through the apertures 38 and 40 which is identified by the letter A in FIG. 3.

The dispensing pump 36 is arranged as a first class lever with respect to the axis "A", with a downwardly depressable, finger engaging contact buttom 42 on the one side of the axis A and a lifter portion 44 on the other side of the axis A. The dispensing pump 36 further has a rod portion 46 which is slidingly reciprocable along a vertically extending axis in an aperture 48 in the bottom wall 30 of the end structure 18 of the body portion 14, and which is connected to the lifter portion 44 by a flexible connector portion 50 of the dispensing pump 36. Thus, by depressing the button 42 of the dispensing pump 36 in the direction of an arrow AR in FIG. 4, the rod portion 46 of the dispensing pump 36 will be lifted along its vertically extending axis within the aperture 48 in the end structure 18. The dispensing pump 36 further has a resilient tail portion 52 which is positioned on the same side of the axis A as the button 42 and which is trapped within the outwardly facing recess 24 of the end structure 18. The tail portion 52 of the dispensing pump 36 serves as a spring to bias the dispensing pump 26 toward the position indicated in FIG. 4 so as to return the dispensing pump 36 to such position upon the removal of the dispensing load applied in the direction of the arrow AR. Motion of the dispensing pump 26 past the FIG. 4 position is blocked by a downwardly facing shoulder 54 on the other side of the lifter portion 44 which engages an upwardly facing shoulder 56 on the dispensing spout 20.

The dispensing pump 36 is further provided with a rodlike member 58 which is attached to the rod portion 46 and which extends downwardly therefrom through the interior of the body portion 14 of the container 12. A lower portion of the rod member 58 passes through an opening 16*a* in the piston 16 for one-way sliding engagement between the rodlike member 58 and the piston 16. A metallic clip 60 is attached to the bottom of the piston 16, and the metallic clip 60 is attached with inwardly and downwardly projecting spaced apart tines 60*a* each of which engages the rodlike member 58 to ensure that the motion of the rodlike member 58 will only be downwardly through the opening 16*a* of the piston 16. Thus, each time that the rodlike member 58 is moved downwardly, it will deflect the tines 60*a* of the metallic clip 60 to move downwardly through the opening 16*a* in the piston 16, and upon the retraction of the rodlike member 58 it will non-slidably engage the tines 60*a* to draw the piston 16 upwardly within the container 12 by a distance which is equal to a pumping stroke of the rodlike member 58. Upon the depressing of the button 42 of the dispensing pump 36 and the resulting lifting of the rodlike member 58 and the piston 16 within the container 12, the piston 16 will pressurize the product P1 within the container 12, thus forcing product P1 through the opening 22 in the dispensing spout 20 of the container 12 in the irregular configuration of the opening 22, shown as a bead B in FIG. 10, and upon the release of the pumping pressure on the button 42, the tail portion 52 of the dispensing pump 36 will return the major portion 34 to its original, FIG. 4 position, thereby depressing the rodlike member 58 through the piston 16 to await the next pumping cycle of the dispensing pump 36.

Striping in the dispensing package 10 of the present invention is accomplished by providing an annular insert 62 having a tapered outer portion 62*a*. The annular insert 62 has a circular outer configuration and fits snugly within the spout 20, which has a polygonal interior configuration, preferably a generally square interior configuration, and thereby forms a circumferentially spaced apart series of four longitudinal passages 64 which terminate adjacent the opening 22 of the dispensing spout in an annular chamber 66 which is defined by the tapered outer portion 62*a* of the annular insert 62 and the inside of the spout 20. Further, the annular insert 62 has an inner end 62*b* which defines an annular recess 68 with an enlarged inner end 20*b* of the dispensing spout 20.

Figure 2:
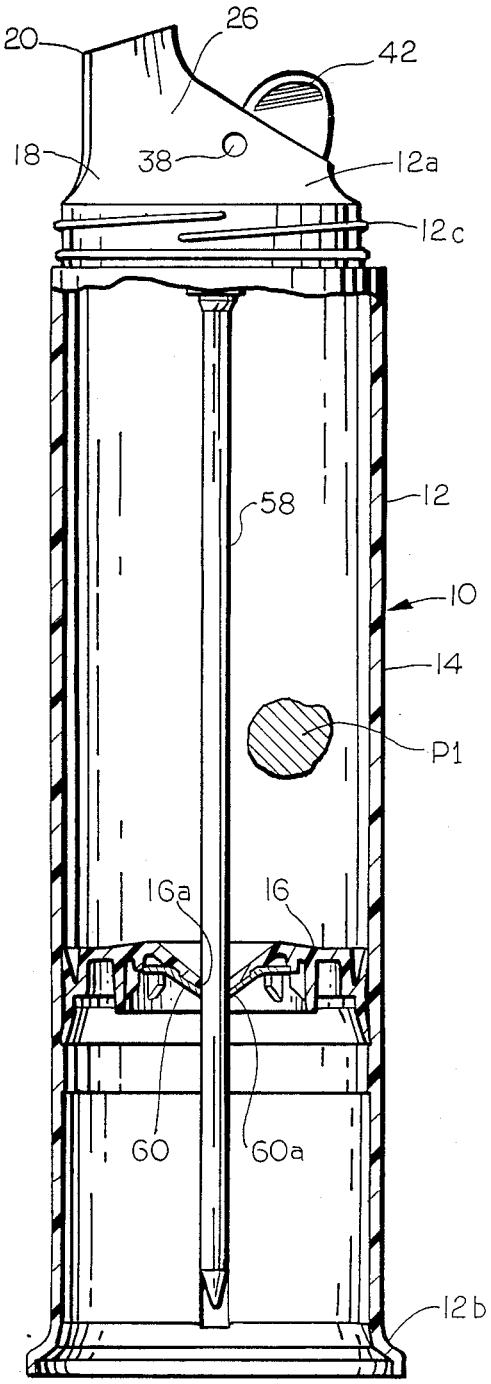
FIG. 2 is an elevational view, at an enlarged scale and partly in section, of the dispensing package of FIG. 1.
Figure 6:
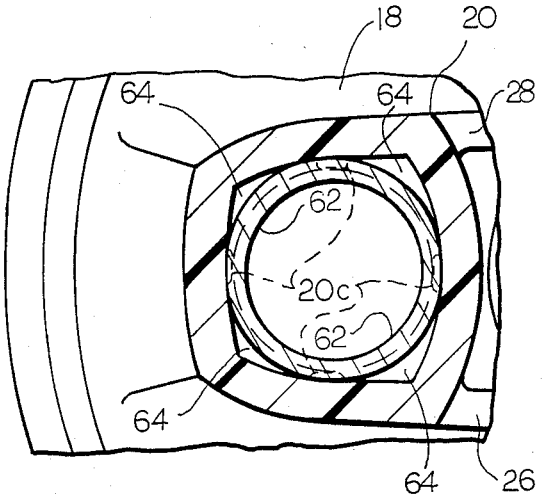
FIG. 6 is a sectional view taken on line 6—6 of FIG. 4.

The annular insert 62 may be manufactured in its illustrated, complex configuration from a suitable thermoplastic material, for example, high density polyethylene or polypropylene, by injection molding. Further, a suitable insert may be manufactured from an aluminum alloy by extrusion. In any case, a second viscous product P2, for example, a product of substantially the same composition as the product P1 but of a contrasting color, is packaged in the annular recess 68 of the container 12, it being important that no portion of the product P2 be packaged below a bottom 62*d* of the annular insert 62. The product P2 is packaged in the container 12, for example, by feeding it into the container 12 while the container 12 is inverted from the position illustrated in FIGS. 1, 2, and 4, and before the feeding of the product P1 into the container 12. Subsequently, while the container 12 is still inverted, the product P1 is fed thereinto, in open communication with the product P2, after which the bottom end 12*b* of the container 12 is closed by inserting the piston 16 thereinto. Thus, when the dispensing pump 36 is actuated, as heretofore explained, the product P1 and the product P2 will be simultaneously pressurized which will result in the extrusion of a composite product having a star-shaped bead B of the product P1 which is dispensed through the interior of the annular insert 62, the discharge spout 20, and the opening 22, and the simultaneous extrusion of circumferentially spaced apart strips or stripes S of the product P2 from the annular recess 68, into the longitudinal passages 64, the annular chamber 66, and then outwardly through the outermost portions of the lobe portions 22*b* of the outlet 22 of the discharge spout 20.

Figure 7:
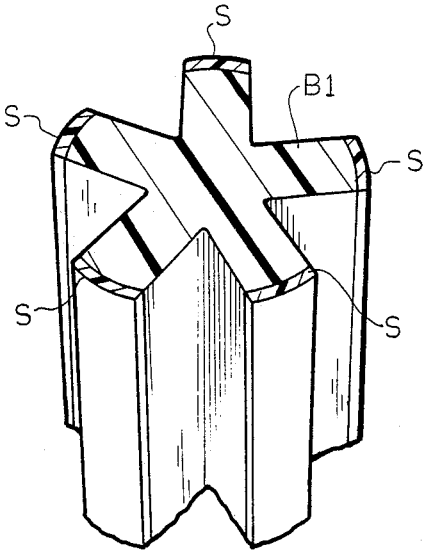
FIG. 7 is a fragmentary perspective view of a composite bead of first and second viscous products that has been dispensed from the striping dispenser package of FIG. 1 through 6.

Thus, as shown in FIG. 7, the strips S of the second product P2 are formed on the tips of the lobes of the star-shaped bead B of the first product P1. The annular insert 62 is accurately positioned in the spout 20 of the container 12, by providing the interior of the discharge spout 20 with spaced apart, inwardly projecting beads 20*c* which are received in indentations 62*e* in the annular insert 62.

Figure 3:
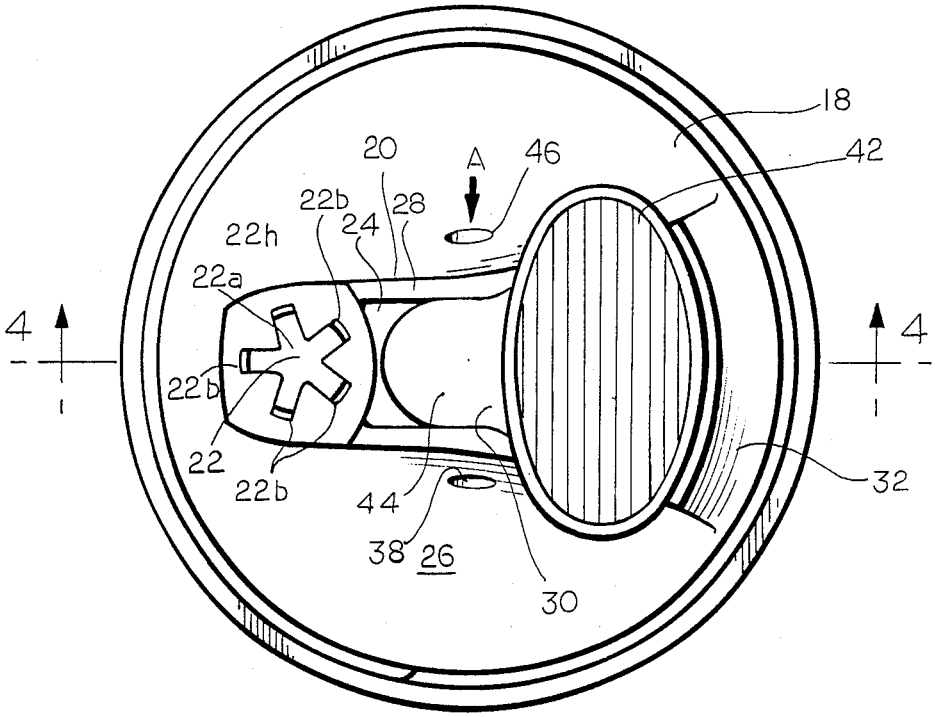
FIG. 3 is a plan view, at a further enlarged scale, of the dispensing package of FIGS. 1 and 2.
Figure 4:
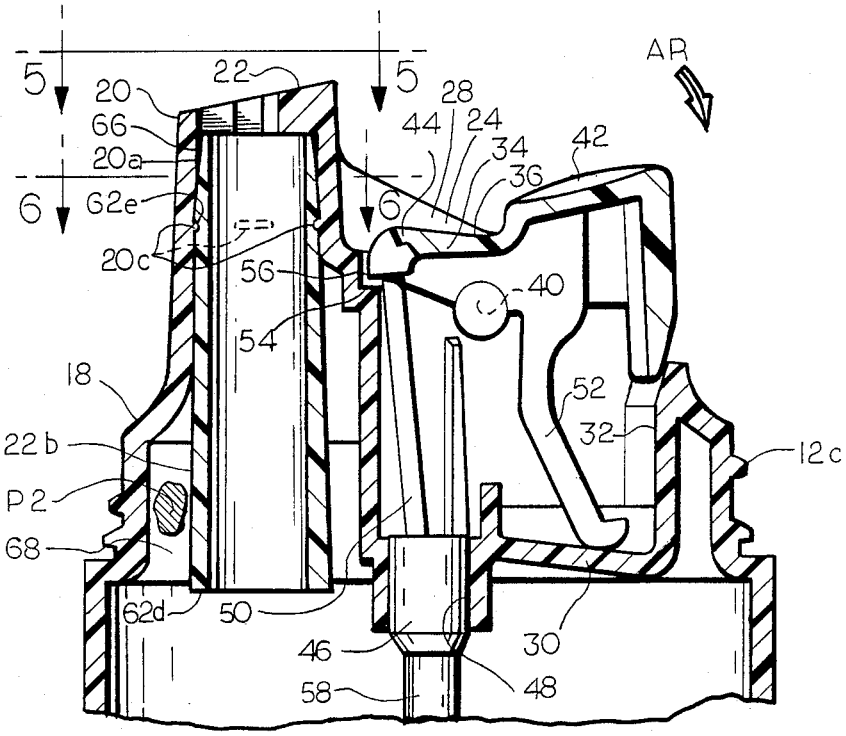
FIG. 4 is a fragmentary sectional view taken on line 4—4 of FIG. 3.
Figure 5:
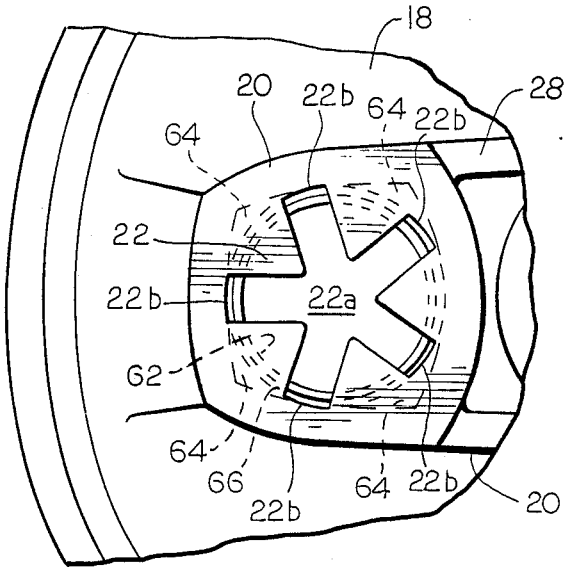
FIG. 5 is a fragmentary plan view taken on line 5—5 of FIG. 4.

While the invention of this application has been described in connection with a dispensing package of the mechanical action type, that is, a package in which the product is pressurized from the bottom by a unidirectionally movable piston that is caused to move by virtue of a mechanical linkage between it and a pumping mechanism at the dispensing end of the package, it is also contemplated that the invention can be practiced in connection with a dispensing package of the vacuum type in which the bottom piston is a floating take-up piston which rises within the container to overcome partial vacuum conditions resulting from the dispensing of product by a separate pumping piston or diaphragm within the container near the dispensing end. FIGS. 3 and 4 of the U.S. Pat. No. 4,691,847 (Ford et al.) illustrate an embodiment of a mechanical action type of dispenser and FIGS. 1 and 2 of the same reference illustrate an embodiment of a vacuum type of dispenser.

Although the best mode contemplated by the inventor for carrying out the present invention as of the filing date hereof has been shown and described herein, it will be apparent to those skilled in the art that suitable modifications, variations, and equivalents may be made without departing from the scope of the invention, such scope being limited solely by the terms of the following claims.

What is claimed is:

1. A dispensing package for containing and dispensing a composite product comprising a first viscous product and a second viscous product, said composite product having a bead of the first viscous product with the second viscous product being applied to the exterior of the bead in at least one longitudinally extending strip, said dispensing package comprising:

a container having a body portion with an inside, a first end and a second end, said first end serving as a dispensing end, said container further having wall means extending across said dispensing end of said container, said wall means forming an elongate, annular dispensing spout, said elongate dispensing spout having an outer, terminal portion and an inner portion, said outer terminal portion having an inside with a first configuration;

an annular insert positioned in said elongate dispensing spout, said annular insert defining an elongate interior passage and comprising an imperforate wall defining an outer portion having an outside with a second configuration positioned snugly within said outer portion of said elongate spout and an inner portion, said second configuration being different than said first configuration, said outer portion of said annular insert and said outer portion of said elongate spout defining at least one longitudinally extending passage, said inner portion of said annular insert forming a recess with said inner portion of said annular dispensing spout, said recess being adapted to receive the second viscous product, said inner portion of said annular insert having a free end which is adapted to be in fluid communication with the first viscous product; and means for pressurizing the first viscous product and the second viscous product to cause the first viscous product to flow from said portion through said annular dispensing spout in a bead by way of said elongate interior passage of said annular insert and to cause the second viscous product to flow from said recess through said annular dispensing spout entirely on the outside of said annular insert in a strip on the outside of the bead of the first viscous product by way of said at least one longitudinally extending passage.

2. A dispensing package according to claim 1 wherein said recess is annular in shape, and wherein said at least one longitudinally extending passage comprises a plurality of longitudinally extending passages circumferentially spaced apart around said annular insert to dispense a composite product having a bead of the first viscous product and a plurality of circumferentially spaced apart and longitudinally extending strips of the second viscous product applied to the exterior of the bead.

3. A dispensing package according to claim 2 wherein one of said first configuration and said second configuration is circular and the other of said first configuration and said second configuration is generally polygonal.

4. A dispensing package according to claim 3 wherein said first configuration is generally polygonal.

5. A dispensing package according to claim 4 wherein said first configuration is generally square.

6. A dispensing package according to claim 1 generally wherein said body portion of said container is generally cylindrical in configuration and has a longitudinal axis, wherein said means for pressurizing comprises pump means at least partly positioned at said dispensing end of said container, said pump means having a rodlike member extending downwardly through said container and parallel to said longitudinal axis and means for reciprocating said rodlike member, a piston initially positioned near said second end of said container, said piston having an aperture receiving and engaging said rodlike member, and means to limit movement between said piston and said rodlike member to movement of said piston within said container along said longitudinal axis toward said dispensing end.

7. A dispensing package according to claim 6 wherein said pump means comprises an elongate portion, said elongate portion being pivotally attached to said wall means extending across said dispensing end of said container for oscillating movement with respect to said dispensing end of said container about an axis positioned between a first end of said elongate portion and a second end of said elongate portion, said rodlike member being attached to said first end of said elongate portion, said second end of said elongate portion having a manually engageable portion to permit said second end to be moved from a first position to a second position, said pump means further comprising resilient means tending to bias said second end of said elongate portion toward said first position.

8. A dispensing package according to claim 1 wherein said container is formed from a rigid thermoplastic material by injection molding.

9. A dispensing package according to claim 8 wherein said thermoplastic material has a principal ingredient selected from the group consisting of high density polyethylene and polypropylene.

10. A dispensing package according to claim 1 and further comprising means longitudinally orienting said annular insert with respect to said dispensing spout.

11. In combination with a mass of a first viscous product and a mass of a second viscous product, a package containing said first viscous product and said second viscous product for dispensing said first viscous product and said second viscous product in a composite product having a bead of said first viscous product with said second viscous product being applied to the exterior strip, said package comprising:

a container having a body portion with an inside, a first end and a second end, said first end serving as a dispensing end, said container further having wall means extending across said dispensing end of said container, said wall means forming an elongate, annular dispensing spout, said elongate dispensing spout having an outer terminal portion and an inner portion, said outer terminal portion having an inside with a first configuration;

an annular insert portioned in said elongate dispensing spout, said annular insert defining an elongate interior passage and comprising an imperforate wall defining an outer portion having an outside with a second configuration positioned snugly within said outer portion of said elongate spout and an inner portion, said second configuration being different than said first configuration, said outer portion of said annular insert and said outer portion of said elongate spout defining a least one longitudinally extending passage, said inner portion of said annular insert forming a recess with said inner portion of said annular dispensing spout, said recess receiving the second viscous product, said inner portion of said annular insert having a free end in fluid communication with said first viscous product; and means for pressurizing said first viscous product and said second viscous product to cause said first viscous product to flow from said portion through said annular dispensing spout in a bead by way of said elongate interior passage of said annular insert and to cause said second viscous product to flow from said recess through said annular dispensing spout entirely on the outside of said annular insert in a strip on the outside of said bead of said first viscous product by way of said at least one longitudinal passage.

12. A combination according to claim 11 wherein said recess is annular in shape, and wherein said at least one longitudinally extending passage comprises a plurality of longitudinally extending passages circumferentially spaced apart around said annular insert to dispense a composite product having a bead of said first viscous product and a plurality of circumferentially spaced apart and longitudinally extending strips of said second viscous product applied to the exterior of said bead.

13. A combination according to claim 12 wherein one of said first configuration and said second configuration is circular and the other of said first configuration and said second configuration is generally polygonal.

14. A combination according to claim 13 wherein said first configuration is generally polygonal.

15. A combination according to claim 14 wherein said first configuration is generally square.

16. A combination according to to claim 11 generally wherein said body portion of said container is generally cylindrical in configuration and has a longitudinal axis, wherein said means for pressurizing comprises pump means at least partly positioned at said dispensing end of said container, said pump means having a rodlike member extending downwardly through said container and parallel to said longitudinal axis and means for reciprocating said rodlike member, a piston initially positioned near said second end of said container, said piston having an aperture receiving and engaging said rodlike member, and means to limit movement between said piston and said rodlike member to movement of said piston within said container along said longitudinal axis toward said dispensing end.

17. A combination according to claim 16 wherein said pump means comprises an elongate portion, said elongate portion being pivotally attached to said wall means extending across said dispensing end of said container for oscillating movement with respect to said dispening end of said container about an axis positioned between a first end of said elongate portion and a second end of said elongate portion, said rodlike member being attached to said first end of said elongate portion, said second end of said elongate portion having a manually engageable portion to permit said second end to be moved from a first position to a second position, said pump means further comprising resilient means tending to bias said second end of said elongate portion toward said first position.

18. A combination according to claim 11 wherein said container is formed from a rigid thermoplastic material by injection molding.

19. A combination according to claim 18 wherein said thermoplastic material has a principal ingredient selected from the group consisting of high density polyethylene and polypropylene.

20. A combination according to claim 11 and further comprising means longitudinally orientating said annular insert with respect to said dispensing spout.

21. A dispensing package for containing and dispensing a composite product comprising a first viscous product and a second viscous product, said composite product having a bead of the first viscous product with the second viscous product being applied to the exterior of the bead in at least one longitudinally extending strip, said dispensing package comprising:

a container having a body portion with an inside, a first end and a second end, said first end serving as a dispensing end, said container further having wall means extending across said dispensing end of said container, said wall means forming an elongate, annular dispensing spout, said elongate dispensing spout having an outer, terminal portion and an inner portion, said outer terminal portion having an inside with a first configuration;

an annular insert positioned in said elongate dispensing spout, said annular insert defining an elongate interior passage and comprising an outer portion having an outside with a second configuration positioned snugly within said outer portion of said elongate spout and an inner portion, said second configuration being different than said first configuration, said outer portion of said annular insert and said outer portion of said elongate spout defining at least one longitudinally extending passage, said inner portion of said annular insert forming a recess with said inner portion of said annular dispensing spout, said recess being adapted to receive the second viscous product, said inner portion of said annular insert having a free end which is adapted to be in fluid communication with the first viscous product; and means for pressurizing the first viscous product and the second viscous product to cause the first viscous product to flow from said portion through said annular dispensing spout in a bead by way of said elongate interior passage of said annular insert and to cause the second viscous product to flow from said recess through said annular dispensing spout in a strip on the outside of the bead of the first viscous product by way of said at least one longitudinally extending passage;

wherein said recess is annular in shape, and wherein said at least one longitudinally extending passage comprises a plurality of longitudinally extending passages circumferentially spaced apart around said annular insert to dispense a composite product having a bead of the first viscous product and a plurality of circumferentially spaced apart and longitudinally extending strips of the second viscous product applied to the exterior of the bead; and wherein said annular dispensing spout has a generally star-shaped outlet with a core portion and a plurality of circumferentially spaced apart lobed portions projecting radially outwardly from said core portion to cause the bead of the first viscous product to have a generally star-shaped configuration with a core portion and a plurality of circumferentially spaced apart lobed portions, wherein said outer portion of said annular insert has a tapered portion, said tapered portion of said annular insert defining an annular chamber with said outer portion of said annular dispensing spout, said second viscous product being applied to outer tip portions of the circumferentially spaced apart lobed portions of the bead of the first viscous product.

22. In combination with a mass of a first viscous product and a mass of a second viscous product, a package containing said first viscous product and said second viscous product for dispensing said first viscous product and said second viscous product in a composite product having a bead of said first viscous product with said second viscous product being applied to the exterior of said bead in at least one longitudinally extending strip, said package comprising:

a container having a body portion with an inside, a first end and a second end, said first end serving as a dispensing end, said container further having wall means extending across said dispensing end of said container, said wall means forming an elongate, annular dispensing spout, said elongate dispensing spout having an outer, terminal portion and an inner portion;

an annular insert portioned in said elongate dispensing spout, said annular insert defining an elongate interior passage and comprising an outer portion having an outside with a second configuration positioned snugly within said outer portion of said elongate spout and an inner portion, said second configuration being different than said first configuration, said outer portion of said annular insert and said outer portion of said elongate spout defining at least one longitudinally extending passage, said inner portion of said annular insert forming a recess with said inner portion of said annular dispensing spout, said recess receiving the second viscous product, said inner portion of said annular insert having a free end in fluid communication with said first viscous product; and means for pressurizing said first viscous product and said second viscous product to cause said first viscous product to flow from said portion through said annular dispensing spout in a bead by way of said elongate interior passage of said annular insert and to cause said second viscous product to flow from said recess through said annular dispensing spout in a strip on the outside of said bead of said first viscous product by way of said at least one longitudinal passage;

wherein said recess is annular in shape, and wherein said at east one longitudinally extending passage comprises a plurality of longitudinally extending passages circumferentially spaced apart around said annular insert to dispense a composite product having a bead of said first viscous product and a plurality of circumferentially spaced apart and longitudinally extending strips of said second viscous product applied to the exterior of said bead; and wherein said annular dispensing spout has a generally star-shaped outlet with a core portion and a plurality of circumferentially spaced apart lobed portions projecting radially outwardly from said core portion to cause said bead of said first viscous product to have a generally star-shaped configuration with a core portion and a plurality of circumferentially spaced apart lobed portions, wherein said outer portion of said annular insert has a tapered portion, said tapered portion of said annular insert defining an annular chamber with said outer portion of said annular dispensing spout, said second viscous product being applied to outer tip portions of the circumferentially spaced apart lobed portions of said bead of said first viscous product.

* * * * *